United States Patent [19]

Bodolay et al.

[11] Patent Number: 4,945,714

[45] Date of Patent: Aug. 7, 1990

[54] FORM, FILL, SEAL AND SEPARATE PACKAGING MACHINE FOR RECLOSABLE CONTAINERS

[75] Inventors: William A. Bodolay; Richard W. Smith; Gregory A. Ward, all of Lakeland, Fla.

[73] Assignee: Package Machinery Company, Bodolay/Pratt Division, Lakeland, Fla.

[21] Appl. No.: 436,911

[22] Filed: Nov. 14, 1989

[51] Int. Cl.[5] ..... B65B 9/08; B65B 43/02; B65B 61/18; B31B 1/64

[52] U.S. Cl. ..... 53/568; 53/128; 53/562; 493/194; 493/198

[58] Field of Search ..... 53/128, 133, 384, 410, 53/412, 550, 553, 562, 567, 568, 570; 493/194, 198, 213, 214, 215, 230, 233, 238

[56] References Cited

U.S. PATENT DOCUMENTS

| | | | |
|---|---|---|---|
| 3,597,895 | 8/1971 | Jensen | 53/570 X |
| 3,744,211 | 7/1973 | Titchenal et al. | 53/384 X |
| 4,179,867 | 12/1979 | Bodolay | 53/389 X |
| 4,514,962 | 5/1985 | Ausnit | 53/570 X |
| 4,522,017 | 6/1985 | Scheffers | 53/384 X |
| 4,523,918 | 6/1985 | Ausnit | 493/198 |
| 4,654,878 | 3/1987 | Lems | 53/568 X |
| 4,665,552 | 5/1987 | Lems et al. | 53/384 X |
| 4,745,731 | 5/1988 | Talbott et al. | 53/551 X |
| 4,832,505 | 5/1989 | Ausnit et al. | 383/63 X |

*Primary Examiner*—Robert L. Spruill
*Assistant Examiner*—Beth Bianca
*Attorney, Agent, or Firm*—Pettis & McDonald

[57] ABSTRACT

A form, fill, seal and separate packaging machine for reclosable containers is accomplished by a plurality of stations disposed along a path of travel of a thermoplastic web including a pair of mated, resealable closure strips present on the base web. The machine is intermittent in its operation, with movement of the web through the machine controlled so that the various steps of forming, filling, sealing and separating the reclosable containers are performed during periodic stops of the machine. The machine is further characterized by its use of two pairs of web belts to move the web through the machine. A first pair of web belts initially receive the folded web stock and partially form and completely fill the containers. The second pair of web belts overlap with the downstream end of the first pair of belts, but are disposed lower than the first belts. When the filled partially formed containers pass from the first pair of belts to the second pair of belts, the unsealed free ends are exposed for final sealing and severing.

22 Claims, 3 Drawing Sheets

FORM, FILL, SEAL AND SEPARATE PACKAGING MACHINE FOR RECLOSABLE CONTAINERS

BACKGROUND OF THE INVENTION

1. Field of the Invention

The present invention relates to a form, fill, seal and separate packaging machine of the type primarily intended for use in packaging material in reclosable containers. The packaging machine of this invention is uniquely characterized by its means for transporting the web through the machine such that material may be placed into the partially filled reclosable containers along a constant, horizontal path of travel.

2. Description of the Prior Art

One of the most significant advancements in the field of flexible packaging in recent years has been the introduction of reclosable, zipper-type plastic bags. While such containers have been publicly available for a number of years for general household use, only recently have such packages been introduced at a retail level for the sale of prepackaged items such as, for example, food products.

As the desirability of such reclosable packages for retail sales has been recognized, so has the need for efficient equipment for automatically forming, filling and sealing such reclosable containers. Numerous such devices are available today, but virtually all such machines presently available share inherent deficiencies primarily related to handling the zipper-type lock strip in the manufacturing and filling process. The packaging industry clearly recognizes that such zipper-type reclosable locks must be substantially impermeable, particularly when the containers are filled with food products, and unnecessary stressing of the reclosable seals must be avoided during the forming and filling process. Accordingly, virtually all present devices for forming, filling, sealing and separating reclosable containers orient the container vertically with the zipper-lock along one vertical edge during the filling process. One example of such a device is disclosed in U.S. Pat. No. 4,745,731 to Talbott, et al. According to the disclosure of that patent, the reclosable container is formed by wrapping the plastic web around a generally vertical fill tube, mating the opposed parts of the zipper-type lock to form a tube, and then filling the receptacles from an open end. Nevertheless, substantial manipulation of the web is required, and great care must be taken to mate the corresponding closure parts to insure a properly formed and sealed container.

It is, therefore, clear that there remains a great need in the art for a form, fill, seal and separate packaging machine suitable for packaging material in reclosable containers wherein the web and particularly its reclosable zipper-type lock are relatively unaffected and not subjected to mechanical stress during the forming, filling, sealing and separating procedures. Furthermore, such a device should be capable of relatively simple adjustment to accommodate the manufacture of reclosable packages of various sizes and weight content.

SUMMARY OF THE INVENTION

The present invention relates to a form, fill, seal and separate packaging machine of the type primarily intended for use in packaging material in reclosable containers. More specifically, the packaging machine of this invention utilizes a base web of thermoplastic material having mating portions of a zipper-type reclosable seal disposed longitudinally along the center of the web. The plastic web is folded onto itself so that the mating parts of the seal lock, and this folded web enters the work stations of the packaging machine for forming, filling, sealing and separating the final reclosable containers. A control drive means is provided to regulate the intermittent travel of the web through the packaging machine so that the various forming, filling, sealing and separating steps are performed simultaneously as the flow of web through the machine is periodically stopped.

The folded web is initially received by first web belt means which direct the folded web into a first station for spot sealing the zipper-type lock at intervals corresponding to the final container width. Means for forming a side seal normal to the closure strips are provided downstream of the means for spot sealing. As the side seal is made, means are provided for partially severing the side seals to define partially formed containers which are open at their free edges held between the first web belt means.

The partially formed containers then advance to the means for filling wherein a pair of opposed bag opening means grip the free edges of the folded web and pull them outwardly to define an open mouth for filling the container. Described in greater detail hereinafter with regard to a preferred embodiment for the packaging machine of this invention are the details of the means for filling whereby the control drive means is actually reversed to provide sufficient "slack" in the web and the first web belt means to permit their separation.

Downstream of the means for filling the first web belt means terminates, and the filled partially formed reclosable containers are transferred to a second web belt means. The path of travel defined by the second web belt means is parallel to the path of travel of the first web belt means, but the second web belt means is disposed slightly below the first web belt means. Thus, as the filled partially formed containers are transferred from the first web belt means to the second, the filled, but only partially formed, containers are held so as to expose their free edges. The containers then enter means for forming a top seal to close the containers completely, and, next, to means for cutting the closed containers from the web to provide individual reclosable packs.

It should also be noted that a load support conveyor is provided immediately beneath the means for filling and extending therefrom beyond the means for cutting and thereby separating the completed containers. The load support conveyor means is in abutting, supporting relation to the fold of the web, thereby reducing, if not virtually eliminating, mechanical stresses placed on the reclosable seal as each container is filled.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
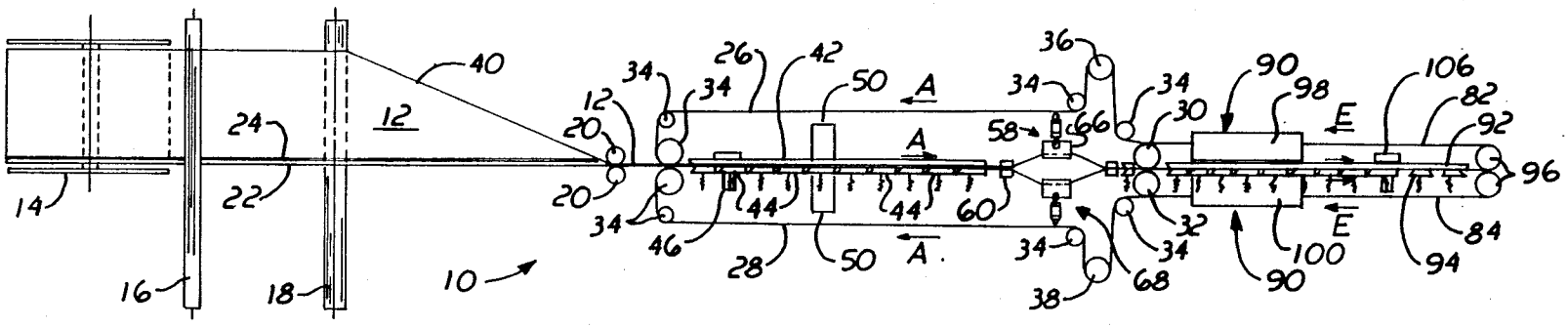
FIG. 1 is a top schematic view of the flow path of the web passing through the various work stations of this packaging machine.
Figure 2:
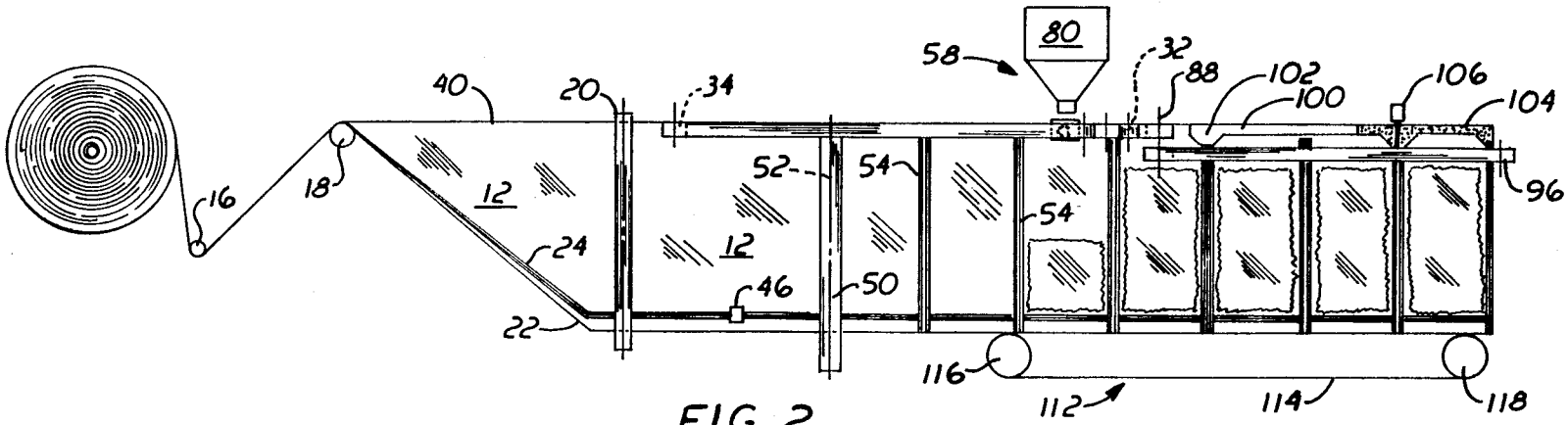
FIG. 2 is a side elevation view of the machine as shown in FIG. 1.

The views of FIGS. 1 and 2 illustrate the packaging machine of this invention, generally indicated as 10. Packaging machine 10 utilizes a folded web 12 of thermoplastic material for forming the containers. As shown in FIGS. 1 and 2, web supply means comprising a reel 14 and delivery rollers 16 and 18 as well as turning rollers 20 provide a supply of web 12 to the remainder of packaging machine 10. As previously described, web 12 is folded, and reference numeral 22 designates the fold.

Thermoplastic web 12 is provided with a pair of mated, resealable closure strips substantially adjacent the fold, and these closure strips define the zipper-type lock 24 by which the complete container is reclosable.

Mounted downstream of the web supply means is the first web belt means comprising a pair of first endless belts 26 and 28. Endless belts 26 and 28 are driven in the direction shown by arrows A by control drive means comprising machine drive rollers 30 and 32. A plurality of guide rollers 34 are also provided for belts 26 and 28. Finally, a pair of festoon rollers 36 and 38 also define elements of the first web belt means, and the festoon rollers 36 and 38 are movable back and forth in the direction normal to the path of travel of web 12 through machine 10 whereby the partially filled container may be opened for filling, as explained hereinafter.

As perhaps best seen in the view of FIG. 1, folded web 12 is turned by rollers 20 such that the free edges 40 are received and held between belts 26 and 28. Positive retention of free edges 40 between belts 28 and 28 is assured by the provision of first web holding means 42 fixedly mounted adjacent belt 26 opposite free edges 40 and a plurality of biased second web holding means 44 mounted in biased engagement adjacent belt 28. Because second web holding means 44 are biased toward belt 28, free edges 40 of folded web 12 are held firmly between belts 26 and 28 and travel therewith as indicated by arrows A. Further details of this structure may be seen in the views of FIGS. 4 and 5.

Figure 3:
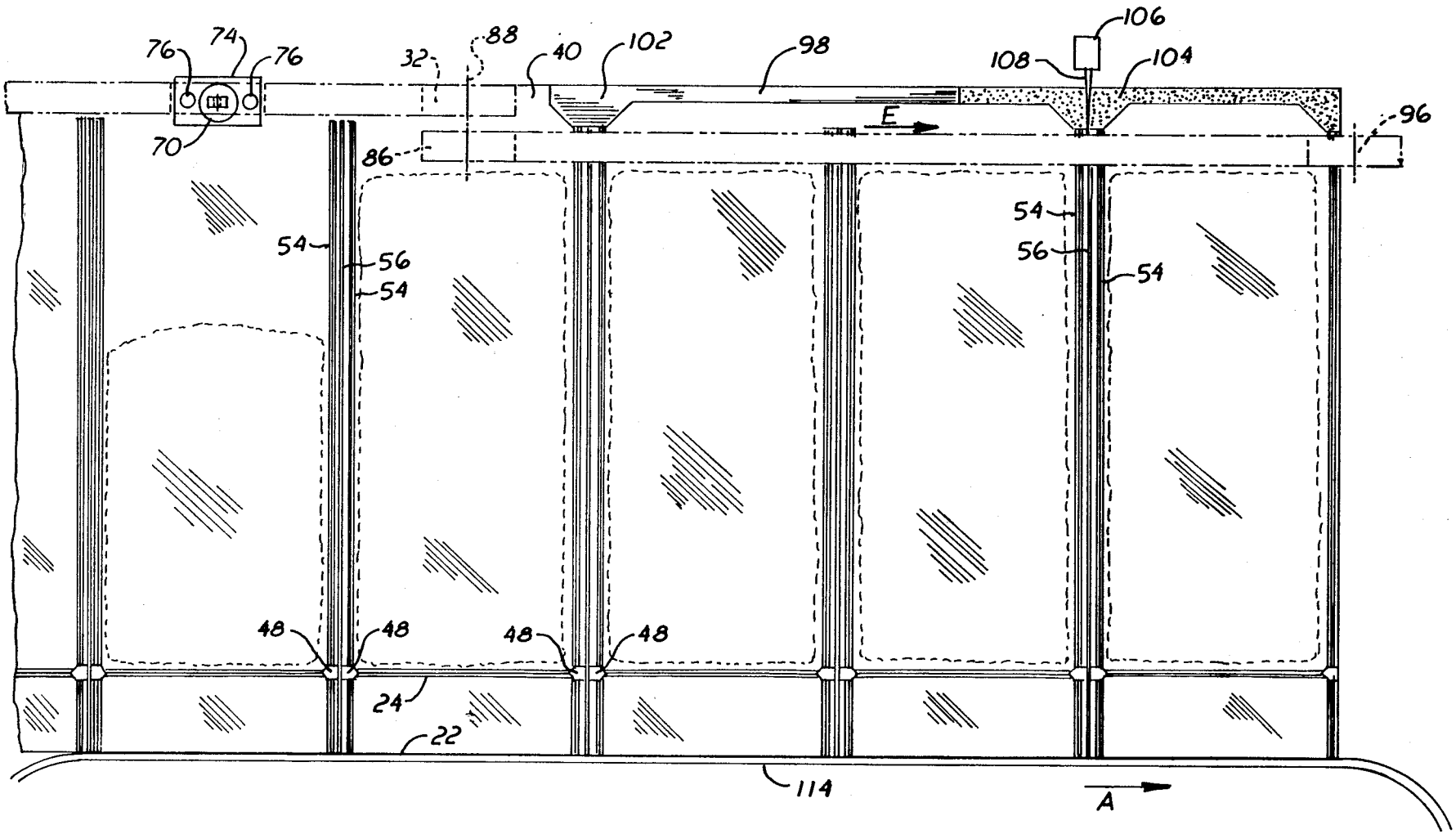
FIG. 3 is a fragmentary detail view showing the means for transferring the web from the first web belt means and the means for top sealing, the means for cutting, and a segment of the load support conveyor means therebelow.

As folded web 12 passes into engagement with first belts 26 and 28 between first web holding means 42 and second web holding means 44, upon stopping drive rollers 30, spot sealer 46 is actuated to seal zipper-type lock 24 as indicated at 48 in the view of FIG. 3. As can be clearly seen in the view of FIG. 3, the distance between spot seals 48 defines the width of the finished container.

Next, the folded web 12 is engaged by means for forming container side seals comprising side seal heater bars 50. As indicated in phantom in the view of FIG. 2, side seal heater bar 50 further includes severing means 52 for substantially bisecting the side seals 54 formed by side seal heater bars 50. Thus, the individual containers are partially severed one from another by cut line 56 as best seen in the view of FIG. 3.

Figure 5:
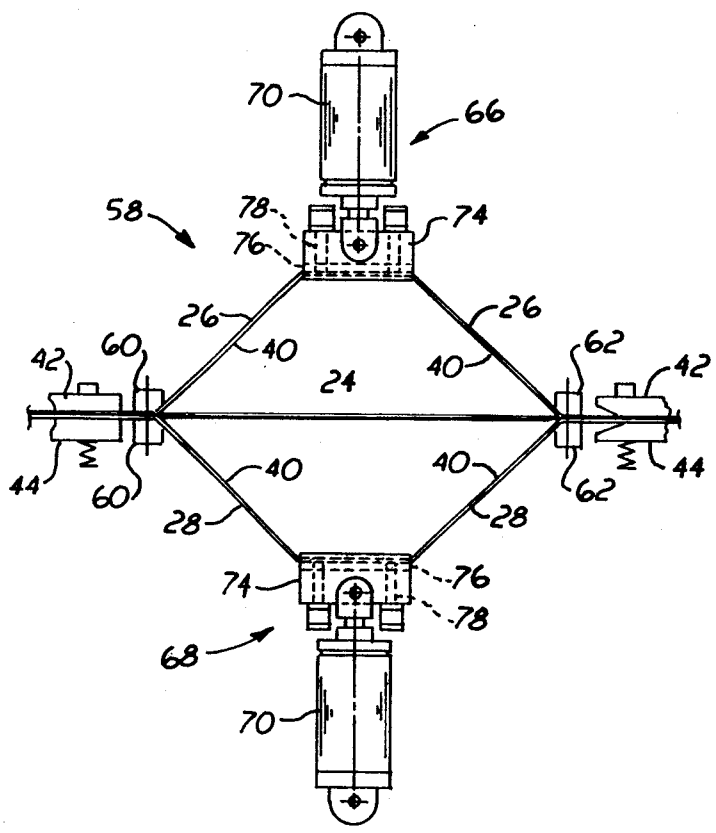
FIG. 5 is a view similar to that of FIG. 4 showing the means for filling in its open position.
Figure 4:
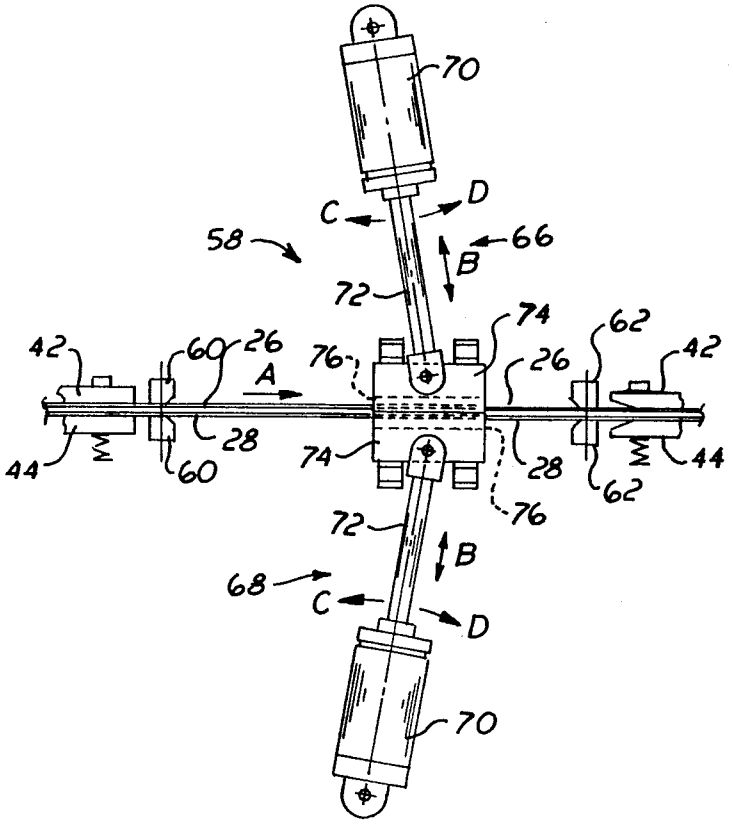
FIG. 4 is a fragmentary detail plan view of the means for filling in its closed position.

The partially formed containers then enter the means for filling, which has been generally indicated as 58. Referring to the views of FIGS. 1, 4 and 5, filling means 58 comprises a first web clamp 60 mounted in engaging, restraining relation to first belts 26 and 28 and free ends 40 held therebetween downstream of the side seal heater bars 50. First web clamp 60 is shown in its open position in the view of FIG. 4, and is closed in the view of FIG. 5. It should be noted that as clamp 60 closes, drive rollers 30 and 32 are stopped. It should also be noted that the drive rollers 30 and 32 are periodically stopped for operation of the various work stations of machine 10. The filling means 58 further comprises a second web clamp 62 also mounted in engaging, restraining relation to first belts 26 and 28 downstream of first web clamps 60. In the view of FIG. 4, the second clamp 62 is also shown in its open position. Referring to the view of FIG. 5, before second clamp 62 is closed, as shown in FIG. 5, drive rollers 30 and 32 would actually reverse direction so that first belts 26 and 28 and their corresponding free edges 40 of folded web 12 could be opened as shown in the view of FIG. 5. Second web clamp 62 is closed as shown in the view of FIG. 5 when mouth 64 of the partially severed container is fully opened as shown in that drawing. Simultaneous with the closing of second web clamp 62, drive rollers 30 and 32 would again be stopped from their reverse direction.

Opening the partially severed container to form mouth 64 is accomplished by the action of first bag opening means and second bag opening means, generally indicated as 66 and 68, respectively. Inasmuch as first bag opening means 66 and second bag opening means 68 are similarly constructed, their structural elements have been assigned like reference numerals. Referring to FIGS. 4 and 5, it can be seen that each of the bag opening means 66 and 68 comprise a cylinder having an extendable/retractable rod 72 extending therefrom. The movement of rod 72 is indicated by directional arrows B. It can also be seen that cylindrical 70 are pivotally mounted to a frame element (not shown) of machine 10. Distal ends of each rod 72 are pivotally mounted to corresponding blocks 74 having a belt and web slot 76 formed therein whereby belts 26 and 28 and their corresponding free edges 40 of folded web 12 may pass therethrough. Mounted within each of the blocks 74 is a pair of movable fingers 78.

In the view of FIG. 4, movable fingers 78 are retracted so as not to interfere with the movement of belts 26 and 28 as well as free edges 40 through belt and web slot 76. However, in the view of FIG. 5, fingers 78 are extended to grip belt 26 and its free edge 40 and belt 28 and its free edge 40 so that mouth 64 may be formed. Movable fingers 78 extend to the position shown in FIG. 5 at substantially the same time as first web clamp 60 closes.

When drive rollers 30 and 32 are reversed, cylinders 70 pivot to the left as shown by directional arrows C and rods 72 retract to form mouth 64. Once the filling operation is complete, drive rollers 30 and 32 resume their normal direction, and rods 72 extend while cylinders 70 pivot to the right as shown by directional arrows D. Upon reaching the position shown in FIG. 4, fingers 78 retract, first web clamp 60 opens, and belts 26 and 28 holding the partially severed filled containers therebetween resume a path of travel as indicated by directional arrow A. As shown in the view of FIG. 2, material is placed into mouth 64 from feed hopper 80. It is also to be noted that as the means for filling 58 is actuated, festoon rollers 36 and 38 move back and forth along a line normal to the path of travel A. It is this movement of festoon rollers 36 and 38 which permit belts 26 and 28 to open to form mouth 64 as shown in FIG. 5.

The filled partially severed containers are next transferred from the first web belt means to the second web belt means comprising second endless belts 82 and 84. As perhaps best seen in the view of FIG. 3, second belt 84 is normally driven in the direction indicated by arrow E by second drive roller 86 which is mounted on the same shaft 88 as first drive roller 32. Though not shown in the drawings, a corresponding second drive roller controls the movement of second endless belt 82 and is similarly mounted immediately below first drive roller 30. Thus it can be seen that the means for transferring the filled, partially severed containers from the first web belt means to the second web belt means basically comprises overlapping the belts downstream of the means for filling 58. In FIG. 3, it can clearly be seen that because second endless belts 82 and 84 are disposed below first belts 26 and 28, a segment of free edges 40 now extends above belts 82 and 84. This unique construction significantly facilitates final sealing and separating of the filled containers.

The filled partially severed containers are next engaged by means for top sealing the containers generally indicated as 90. However, it is also to be noted that, as with the first web belt means, the second web belt means comprises third web holding means 92, corresponding to first web holding means 42, and biased fourth web holding means 94, corresponding to biased second web holding means 44. Finally, guide rollers 96 are also provided for belts 82 and 84.

The means for top sealing 90 comprises any suitable device such as, for example, heater bars 98 and 100 for bonding the exposed free ends 40 to each other. As best seen in the view of FIG. 3, heater bar 98 includes an elongated portion which is somewhat longer than the width of the filled container, and an enlarged head 102. It should be noted that head 102 intersects the partially severed side seal 54 and, in combination with the elongated arm of heater bar 98 completely seals free edges 40 of the filled container. The completed top seal is indicated by cross hatching 104 in the view of FIG. 3.

The filled sealed containers are severed from web 12 by the action of cutting means 106. The cutting means 106 comprises a knife 108 having a relatively blunt tip 110. Upon actuation of cutting means 106, the blunt tip 110 will enter cut line 56, and knife 108 will sever the filled, sealed container from web 12.

In order to support the filled containers, both partially severed and totally severed, machine 10 further comprises a load support conveyor means generally indicated as 112 in the view of FIG. 2. Load support conveyor means 112 comprises an endless belt 114 having a direction of travel substantially parallel to that of the machine half of travel and is indicated by directional arrow A in the view of FIG. 3. Through means not shown, movement of endless belt 114 around its rollers 116 and 118 corresponds to the movement of drive rollers 30 and 32 and second drive roller 86. As is clearly apparent in the views of FIGS. 2 and 3, load support conveyor means 112 engages fold 22 of filled containers to relieve stress which might be placed on zipper-type lock 24 as well as on top edges 40.

Having thus set forth a preferred construction for the packaging machine 10 of this invention, attention is invited to a consideration of numerous advantages derived from the machine and additional structural details of the preferred embodiment. First, while the invention has been described with regard to a supply of thermoplastic web material comprising a pre-folded roll, it certainly is within the scope of this invention to provide the base web material in a flat roll, and to provide a series of guide rollers for folding the web onto itself and closing the zipper-type lock 24 as the folded web 12 approached and entered the nip between first endless belts 26 and 28.

In this preferred embodiment, it can be seen that the first web holding means 42 and the third web holding means 92 are of a continuous, bar-shaped configuration. It is to be understood that these first and third web holding means 42 and 92 could be formed from a plurality of fixed segments. It may also be noted that in this preferred embodiment, the length of individual second web holding means 44 and fourth web holding means 94 is in the range of two to three inches; however, the scope of the invention certainly is not limited thereto.

While virtually any motor and control means suitable for use in intermittent operation packaging machines may be utilized to drive the control drive means of machine 10, a stepper or servo motor has been found to be preferable since such a motor permits very precise regulation of the direction of the flow path, the speed of the flow path, and those parameters are easily adjusted to permit forming filled and sealed containers of various dimensions. Therefore, in this preferred embodiment, first belts 26 and 28 as well as second belts 84 and 86 are constructed to define a flat, smooth surface abutting the free edges 40 and a toothed opposite surface whereby incremental movement of the stepper or servo motor driving the control drive means is very precisely translated to corresponding movement of those belts. This insures high levels of quality control with regard to the finished package fabricated by machine 10.

It is also to be understood that once folded web 12 enters the various work stations of machine 10, each work station performs its task simultaneously, during the dwell time when the web is stopped. Of significant importance to machine 10 is the operation of filling means 58. When folded web 12 is stopped, first web clamp 60 and movable fingers 78 close. The direction of both the first web belt means and the second web belt means path of travel is reversed, and first bag opening means 66 and second bag opening means 68 operate to spread free edges 40 apart to form mouth 64. When mouth 64 is properly formed, the motor control means again stops both the first and second web belt means and second web clamp 62 engages. Material is fed into mouth 64 from feed hopper 80, and the motor control means resumes operation of both the first and second web belt means along the normal path of travel. Simultaneously, second web clamp 62 releases and first and second bag opening means 66 and 68 move from the position shown in FIG. 5 to that shown in FIG. 4, thereby closing mouth 64. When mouth 64 is closed, movable fingers 78 release and first web clamp 60 also releases for movement to the next machine cyle. Even if very heavy material is being deposited into the container, the likelihood of damaging the container is virtually eliminated by the supporting action of load support conveyor means 112.

Finally, once the completed container has been severed from folded web 12, an extension of the load support conveyor means 112 could actually be used to deliver the completed container to a collection point. In order for the completed container to be used, all that is necessary is for the user to trim the fold 22 away using scissors or any such suitable device. The container may be opened by pulling apart zipper-type lock 24, desired contents may be removed, and the container may be reclosed by pressing the two strips forming zipper-type lock 24 together.

It is also to be understood that machine 10 is easily adaptable to form, fill, seal and separate reclosable containers of various widths and heights. To change bag width, all that is necessary is to reposition the longitudinal distance between the various work stations and correspondingly vary the control drive means. For containers of different height, load support conveyor means 112 is adjustable vertically. It should also be noted that machine 10 is extremely suitable for packaging food products or medications because at no time does any part of the machine 10 invade the interior of the container. Only a relatively small portion of the belt and web slots 76 contact the interior of the container, and that area of free edges 40 is bonded together by the action of top sealing means 90. In fact, machine 10 could be adapted with relative ease to form, fill, and seal the reclosable containers within a sterile environment.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A form, fill, seal and separate packaging machine of the type primarily intended for use in packaging material in reclosable containers formed from a thermoplastic web folded upon itself, said web having a pair of mated, reseable closure strips substantially adjacent the fold and free edges opposite said closure strips, said machine comprising: web supply means for providing a source of said folded web; first web belt means for receiving and conveying said folded web along a path through said machine; second web belt means disposed at least partially downstream of said first belt means and below said first belt means, said second belt means receiving and conveying said folded web along said path; means for spot sealing said closure strips downstream of said web supply means; means for forming a side seal substantially normal to said closure strips and downstream of said spot sealing means, each of said side seals intersecting a corresponding one of said spot seals, whereby a series of partially formed containers are made as said folded web moves along said path; means for partially severing said partially formed container by substantially bisecting each of said side seals along a line extending from said one spot seal to the portion of said side seal adjacent said first web belt means; means for filling said partially severed containers downstream of said means for severing; means for transferring said filled partially severed containers to said second web belt means such that a segment of each of said filled partially severed containers extends above said second belt means; means for top sealing said free edges of said filled partially severed containers downstream of said means for transferring; and means for cutting said filled partially severed containers from said web.

2. A machine as in claim 1 further comprising a load support conveyor means mounted below said means for filling and extending therefrom beyond said means for cutting, said load support conveyor means being in abutting, support relative to the fold of said web, whereby said filled containers are supported by said load support conveyor means.

3. A machine as in claim 2 wherein said load support conveyor means comprises an endless belt having a direction of travel substantially parallel to said path.

4. A machine as in claim 1 wherein said web supply means comprises a roll of said folded web.

5. A machine as in claim 1 wherein said first web belt means comprises a pair of first endless belts configured to receive and hold said free edges therebetween, whereby said folded web is moved along said path.

6. A machine as in claim 5 wherein said first web belt means further comprises first web holding means fixedly mounted adjacent one of said first endless belts opposite said free edges and a plurality of second web holding means mounted in biased engagement adjacent the other of said first endless belts opposite said free ends, whereby said free ends are held between said pair of first endless belts by the biasing force exerted by said second web holding means.

7. A machine as in claim 6 wherein said first web belt means further comprises a control drive means for moving said first endless belts to define said path of travel, and a plurality of guide rollers around which said first belts move.

8. A machine as in claim 1 wherein said means for forming a side seal and said means for partially severing are unitary, whereby said side seal is partially severed as it is formed.

9. A machine as in claim 1 wherein said means for filling comprises a first web clamp mounted in engaging, restraining relation to said first endless belts and said free ends held therebetween downstream of said means for partially severing, and a second web clamp mounted in engaging, restraining relation to said first endless belts and said free ends held therebetween upstream of said means for transferring.

10. A machine as in claim 9 wherein said means for filling further comprises first and second bag opening means operatively mounted between said first and second web clamps.

11. A machine as in claim 10 wherein said first and second bag opening means are disposed in opposing relation to each other, said first bag opening means being movably mounted adjacent said one first endless belt having first web holding means adjacent thereto, and said second bag opening means being movably mounted adjacent each other of said first endless belts.

12. A machine as in claim 11 wherein said first bag opening means comprises a first web and belt slot through which said one first endless belt and its corresponding one of said free ends passes, and wherein said second bag opening means comprises a second web and belt slot through which said other first endless belt and its corresponding one of said free ends passes.

13. A machine as in claim 12 wherein each of said first and second web and bag slots comprise at least one movable finger mounted therein for gripping its corresponding first endless belt and free end in its said slot.

14. A machine as in claim 13 wherein said first and second bag opening means further comprise corresponding first and second cylinders for moving said bag opening means to separate said free ends from each other, whereby said partially severed containers may be filled.

15. A machine as in claim 14 wherein said means for filling further comprises a fill hopper for directing material between said separated free ends to fill said partially severed containers.

16. A machine as in claim 15 wherein said means for filling further comprises at least one festoon roller for each of said first endless belts, whereby said first belts may be separated from each other by the movement of said first and second bag opening means.

17. A machine as in claim 1 wherein said means for transferring comprises the overlapping of said first web belt means with said second web belt means downstream of said means for filling and upstream of said means for top sealing.

18. A machine as in claim 1 wherein said second web belt means comprises a pair of second endless belts configured to receive and hold said filled partially severed containers therebetween such that said free ends and a segment of said partially severed side seals are exposed above said second endless belts.

19. A machine as in claim 18 wherein said second web belt means further comprises third web hold means fixedly mounted adjacent one of said second endless belts opposite said free edges and a plurality of fourth web holding means mounted in biased engagement adjacent the other of said second endless belts opposite said free ends, whereby said free ends are held between said pair of second endless belts by the biasing force exerted by said fourth web holding means.

20. A machine as in claim 19 wherein said second web belt means further comprises a control drive means for moving said second endless belts to define said path of travel, and a plurality of guide rollers around which said second belts move.

21. A machine as in claim 20 wherein said means for top sealing comprises means for bonding said exposed free ends to each other and for intersecting at least one of said partially severed side seals, whereby said containers are closed.

22. A machine as in claim 21 wherein said means for cutting comprises a knife having a blunted tip, whereby said tip will enter said exposed partially severed side seal, said knife having a sharpened edge proximate said tip, whereby said side seal is finally cut to sever filled containers from said web.

* * * * *

UNITED STATES PATENT AND TRADEMARK OFFICE

CERTIFICATE OF CORRECTION

PATENT NO. : 4,945,714

DATED : AUGUST 7, 1990

INVENTOR(S) : Bodolay, et al.

It is certified that error appears in the above-identified patent and that said Letters Patent is hereby corrected as shown below:

Claim 2, column 8, line 15, "support relative" should be "supporting relation--.

Claim 11, column 8, line 63, "each" should be --said--.

Signed and Sealed this

Twenty-sixth Day of May, 1992

*Attest:*

DOUGLAS B. COMER

*Attesting Officer*

*Acting Commissioner of Patents and Trademarks*